US010228134B2

(12) United States Patent
Tonon et al.

(10) Patent No.: US 10,228,134 B2
(45) Date of Patent: Mar. 12, 2019

(54) DAMPER FOR GAS TURBINE

(71) Applicant: ALSTOM Technology Ltd, Baden (CH)

(72) Inventors: Devis Tonon, Turgi (CH); Mirko Ruben Bothien, Zürich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 458 days.

(21) Appl. No.: 14/742,839

(22) Filed: Jun. 18, 2015

(65) Prior Publication Data

US 2015/0377487 A1 Dec. 31, 2015

(30) Foreign Application Priority Data

Jun. 30, 2014 (EP) ..... 14174945

(51) Int. Cl.
*F23R 3/00* (2006.01)
*F01N 1/00* (2006.01)
(Continued)

(52) U.S. Cl.
CPC ..... *F23R 3/002* (2013.01); *F01N 1/00* (2013.01); *F01N 1/003* (2013.01); *F01N 1/02* (2013.01); *F01N 1/023* (2013.01); *F01N 1/026* (2013.01); *F23M 20/005* (2015.01); *F23R 3/44* (2013.01); *F05B 2260/96* (2013.01);
(Continued)

(58) Field of Classification Search
CPC ..... F23R 3/002; F23R 2900/00001; F23R 2900/00005; F23R 2900/00014; F01N 1/00; F01N 1/003; F01N 1/02; F01N 1/023; F01N 1/026; F05B 2260/96; F05B 2260/964; F05D 2260/96; F05D 2260/963; F23M 20/005
See application file for complete search history.

(56) References Cited

U.S. PATENT DOCUMENTS

2005/0223707 A1* 10/2005 Ikeda ..... F23R 3/04 60/725
2008/0216481 A1* 9/2008 Pollarolo ..... F23R 3/50 60/725
2012/0228050 A1* 9/2012 Bulat ..... F01N 1/023 181/213

FOREIGN PATENT DOCUMENTS

DE 43 05 333 C1 7/1994
EP 1 624 250 A1 2/2006
(Continued)

OTHER PUBLICATIONS

"Surface Temperatures: Underhood", https://cs.stanford.edu/people/eroberts/courses/ww2/projects/jet-airplanes/how.html, accessed Jun. 21, 2018.*

(Continued)

*Primary Examiner* — Scott Walthour
(74) *Attorney, Agent, or Firm* — Buchanan Ingersoll & Rooney PC

(57) ABSTRACT

The present invention generally relates to a gas turbine and more in particular it is related to a damper assembly for a combustion chamber of a gas turbine. According to preferred embodiments, the present solution provides a damper assembly including protrusions on a wall of the neck. These protrusions result in a side wall reactance to the acoustic field that has the effect of decreasing the effective speed of sound in the neck. The decrease of the effective speed of sound in the neck is equivalent to an increase of the effective neck length.

15 Claims, 6 Drawing Sheets

(51) Int. Cl.
*F01N 1/02* (2006.01)
*F23M 20/00* (2014.01)
*F23R 3/44* (2006.01)

(52) U.S. Cl.
CPC .... *F05B 2260/964* (2013.01); *F05D 2260/96* (2013.01); *F05D 2260/963* (2013.01); *F23R 2900/00001* (2013.01); *F23R 2900/00005* (2013.01); *F23R 2900/00014* (2013.01)

(56) References Cited

FOREIGN PATENT DOCUMENTS

| | | | | | |
|---|---|---|---|---|---|
| EP | 2 302 302 | A1 | | 3/2011 | |
| EP | 2 474 784 | A1 | | 7/2012 | |
| EP | 2865948 | A1 | | 4/2015 | |
| JP | 04246221 | A | * | 9/1992 | ..... F01N 1/023 |
| WO | 2013/144070 | A1 | | 10/2013 | |

OTHER PUBLICATIONS

Relevant portion of "The Jet Engine: A Historical Introduction", http://depts.washington.edu/vehfire/ignition/autoignition/surftemper.html, accessed Jun. 21, 2018.*

European Office Action for European Patent Application Serial No. 14 174 945.7 dated Jul. 19, 2017.

Chapter 11 "Corrugated Pipe Flow," J.W. Elliot; Sep. 9, 2004.

"Whistling of a pipe system with multiple side branches: Comparison with corrugated pipes" D. Tonon, B.J.T. Landry, S.P.C. Belfroid, J.F.H. Willems, G.C.J. Hofmans, A. Hirschberg; Nov. 14, 2009; Journal of Sound and Vibration 329 (2010) 1007-1024.

"Aeroacoustics of Shear Layers in Internal Flows: Closed Branches and Wall Perforations" by Tonon, D.; Technische Universiteit Eindhoven University of Technology, Published Jan. 1, 2011.

* cited by examiner

DAMPER FOR GAS TURBINE

CROSS-REFERENCE TO RELATED APPLICATIONS

This application claims priority to European application 14174945.7 filed Jun. 30, 2014, the contents of which are hereby incorporated in its entirety.

TECHNICAL FIELD

The present invention generally relates to a gas turbine and more in particular it relates to a damper assembly for a combustion chamber of a gas turbine.

BACKGROUND

As well known, in conventional gas turbines, acoustic oscillation usually occurs in the combustion chambers of the gas turbines. With the term chamber is intended any gas volume where combustion dynamics occur. In such chambers the flow of a gas (for example a mixture of fuel and air or exhaust gas) with high velocity usually creates noise. Burning air and fuel in the combustion chamber causes further noise. This acoustic oscillation may evolve into highly pronounced resonance. Such oscillation, which is also known as combustion chamber pulsations, can reach amplitudes and associated pressure fluctuations that subject the combustion chamber itself to severe mechanical loads that may decisively reduce the life of the combustion chamber and, in the worst case, may even lead to destruction of the combustion chamber.

To reduce the acoustic oscillations noise it is well known in the art to install acoustic damping devices like Helmholtz resonators.

Typically, these kinds of dampers are physical devices that are often positioned around the combustion chamber (on the liner, on the front panel). They usually include an empty volume (where air can flow) and a neck that connects the volume to the combustion chamber.

The resonance frequency and damping power of a Helmholtz damper depends on its geometry and on the flow through its neck. The maximum dimensions of a Helmholtz damper to be used in a gas turbine can be limited due to geometrical constraints imposed by the section where the damper needs to be mounted. A particularly stringent constraint consists of the maximum length of the neck, as the latter is one of the key parameter which affects the damping capabilities of such device. Limitations in the neck length limit the damper effectiveness, in terms of frequency that can be targeted and damping.

However, if the desired length of neck, selected in order to achieve the most suitable frequency associated to the operative conditions of the machine, is longer than what is geometrically allowed (taking into consideration the available space around the combustion chamber), the solution generally adopted is to narrow the neck diameter. Nevertheless, such solution inevitably decreases the damper efficiency.

SUMMARY

The object of the present invention is to solve the aforementioned technical problems by providing a damper assembly 1 as substantially defined in independent claim 1.

Moreover, the object of the present invention is also to provide a combustion chamber for a gas turbine as substantially defined in dependent claim 9.

Preferred embodiments are defined in correspondent dependent claims.

According to preferred embodiments, which will be described in the following detailed description only for exemplary and non-limiting purposes, the present solution provides a damper assembly comprising protrusions on a wall of the neck. As it will be clear from the following detailed description, these protrusions result in a side wall reactance to the acoustic field that has the effect of decreasing the effective speed of sound in the neck. The decrease of the effective speed of sound in the neck is equivalent to an increase of the effective neck length.

If, for a given volume, a lower frequency should be targeted, the known art teaches to increase the neck length or decrease its diameter. The damper according to the present invention has a clear and unique advantage if compared to existing practice. As already mentioned, according to existing solutions a lower frequency of a damper is achieved by narrowing the neck diameter, given the volume and having already reached the maximum length of the neck (longer neck means lower frequency). But this solution decreases the damping power.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION

Figure 1:
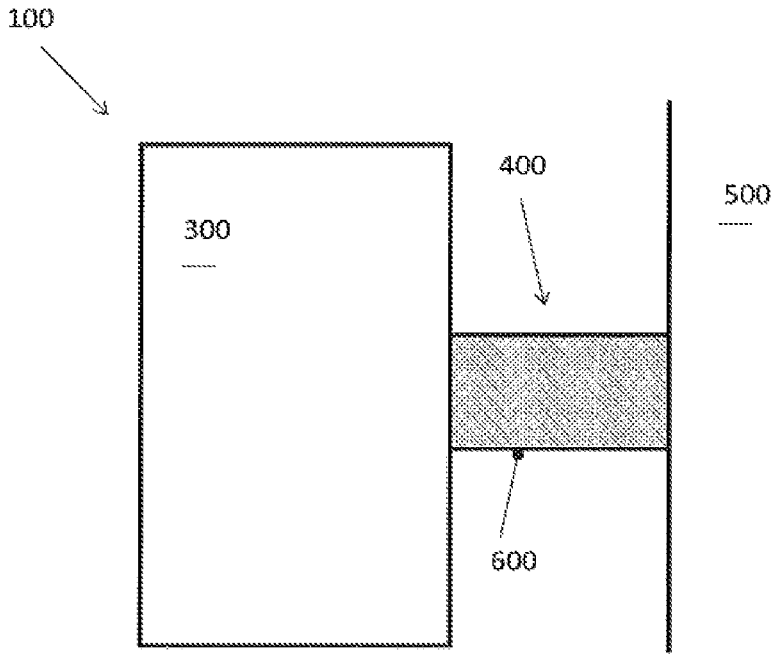
PRIOR ART FIG.1
FIG. 1 shows a schematic side view of a damper according to the prior art.

With reference to FIG. 1, it is showed a side view of a damper assembly 100 according to the prior art. As known, the damper assembly 100 comprises a resonator cavity 300 in flow communication with a combustion chamber 500 through a neck 400. Typically, the neck 400 has a uniform cross-section, which could be, by way of example, circular or rectangular. The neck 400 has an outer wall 600 which defines a flow channel that hence puts in communication the resonator cavity 300 and the combustion chamber 500.

Figure 2:
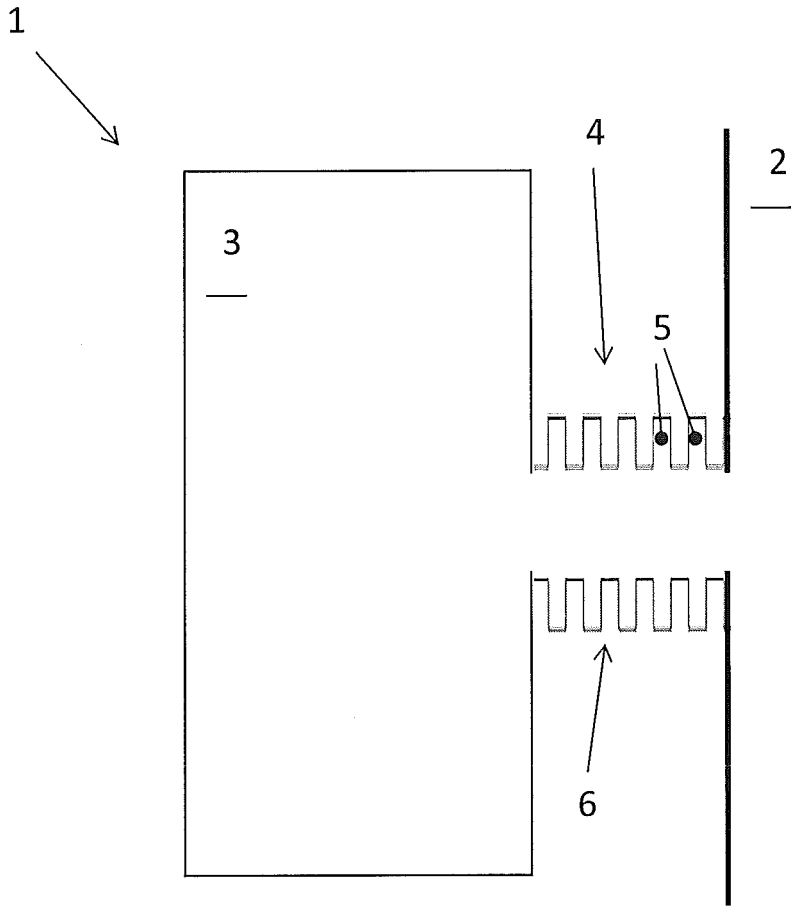
FIG. 2 shows a schematic side view of a damper assembly according to the present invention.

Making now reference to following FIG. 2, it is schematically shown, a side view of a damper assembly 1 according to the invention. The damper assembly 1 comprises a resonator cavity 3 and a neck 4. The neck 4 puts in fluid communication the resonator cavity 3 with a combustion chamber, schematically denoted with numeral reference 2. In particular, the neck 4 comprises now protrusions 5 located on its outer wall 6. In the example shown, the neck 4 comprises a plurality of protrusions on the outer wall 6, but it will be appreciated that the outer wall 6 may even have only one protrusion, of any shape. Even in this configuration, the damper assembly 1 according to the present invention results in an advantageous effect with respect to a damper assembly according to the known art, where the neck has a uniform cross-section along its longitudinal development. Protrusions are preferably annular-shaped and arranged around the neck 4 of the damper assembly 1. Moreover, protrusions 5 may have a variety of shapes.

Figure 3:
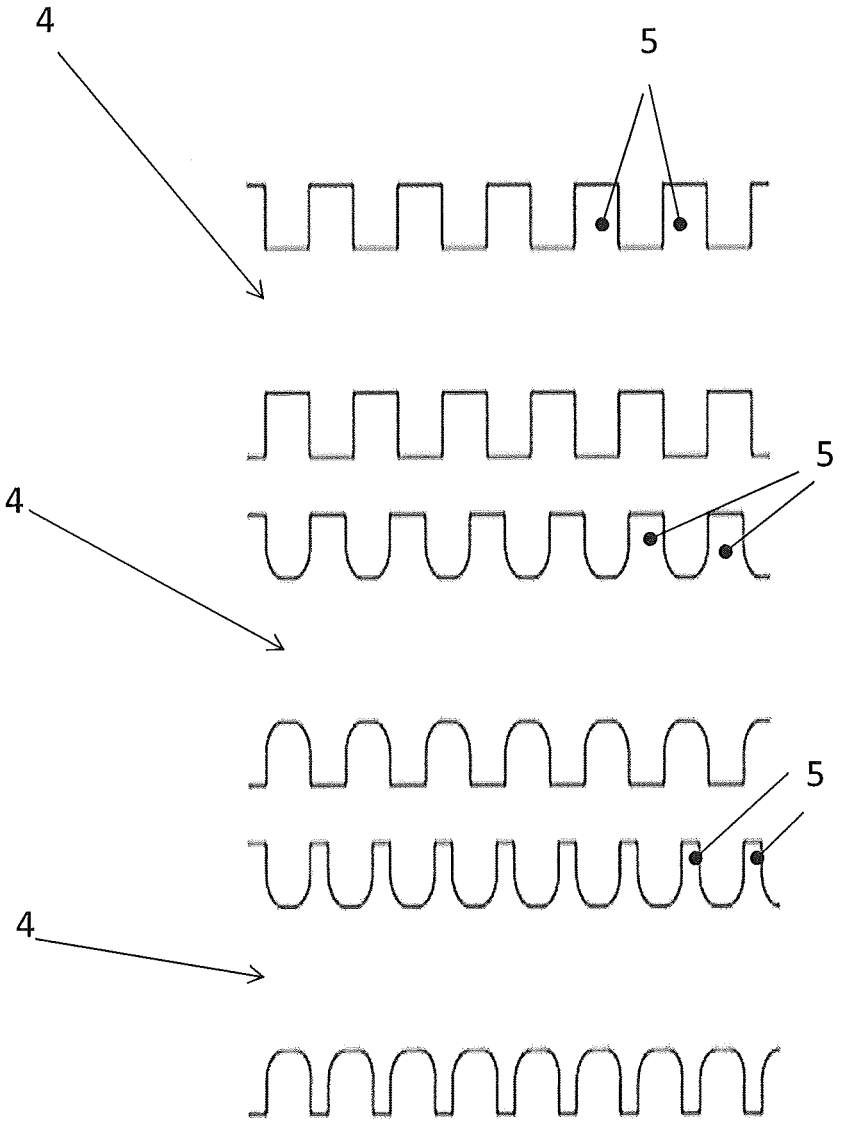
FIG. 3 shows different embodiments of a damper neck according to the present invention.

In particular, with reference to FIG. 3, protrusions 5 may have a rectangular cross-section, or a more general curved cross-section. Preferably, the annular-shaped protrusions are equally distanced along the neck 4. According to the preferred embodiment here disclosed as a non-limiting case, the neck 4 may have a typical configuration of a corrugated neck. Furthermore, the protrusions 5 are preferably directed outward of the neck 4.

As mentioned above, the protrusions 5 arranged on the neck 4 of the damper assembly result in a side wall reactance to the acoustic field which decreases the effective speed of sound in the neck. The decrease of the effective speed of sound in the neck is equivalent to an increase of the effective neck length.

The effective speed of sound $c_{eff}$ in a pipe with protrusions has been derived analytically by Cummings [1]. In Cummings model the effect of the fluid in each cavity is limited to the compressibility of the protrusion, or "cavity" if considered from the internal volume of the neck, in which the pressure is assumed to be uniform and equal to the pressure in the main pipe:

$$c_{eff} = c_0 \frac{1}{\sqrt{1 + \frac{V_{corr}}{Sl}}}$$

$c_{eff}$=effective speed of sound
$V_{corr}$=corrugation cavity volume
l=corrugation pitch
S=surface area of the pipe
$c_0$=speed of sound The predictions of the model of Cummings have been confirmed experimentally and by means of simulations with an acoustic network model by Tonon et al. [2,3].

Figure 4:
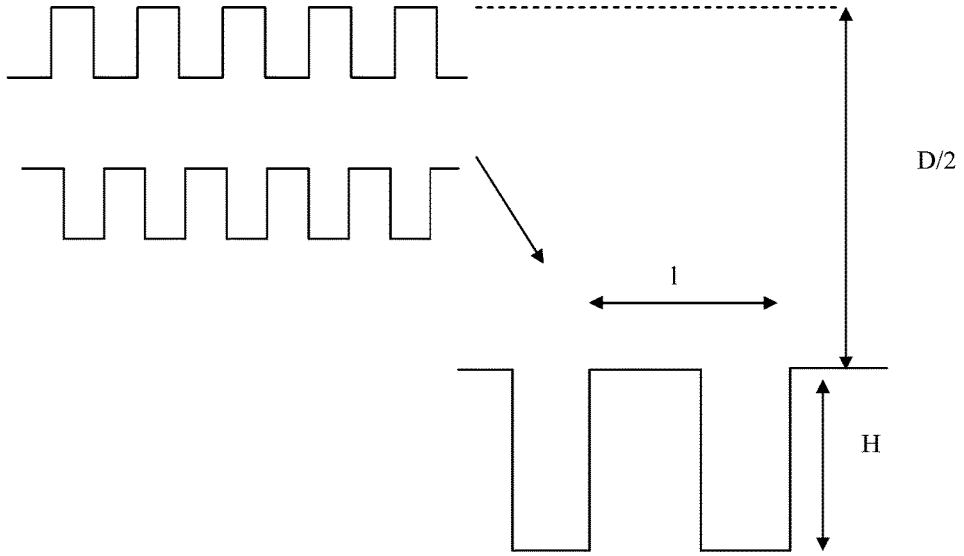
FIGS. 4 and 5 show a particular of the geometry of a damper neck according to the present invention.

With reference to FIG. 4, which shows a particular of an exemplary corrugated geometry chosen for the neck of the damper assembly, the following mathematical relations can be considered with reference to terms above introduced:

$$V_{corr} = \frac{\pi}{2} H(2H + D)W$$

$$S = \frac{\pi}{4} D^2$$

Considering a neck with uniform cross-section according to the prior art, with a length L, the resonance frequencies can be expressed as:

$$f_{res} = \frac{1}{2} n \frac{c_0}{L}$$

$$n = 1, 2, 3, \ldots$$

Considering now a corrugated neck, according to the present invention, the resonance frequencies can be similarly expressed as:

$$f_{res} = \frac{1}{2} n \frac{c_{eff}}{L}$$

$$n = 1, 2, 3, \ldots$$

But since the following relation stands:

$$c_{eff} = c_0 \frac{1}{\sqrt{1 + \frac{V_{corr}}{Sl}}}$$

It follows that:

$$f_{res} = \frac{1}{2} n \frac{c_0}{L\sqrt{1 + \frac{V_{corr}}{Sl}}} = \frac{1}{2} n \frac{c_0}{L_{eff}}$$

$$n = 1, 2, 3, \ldots$$

And hence the effective neck length is:

$$L_{eff} = L\sqrt{1 + \frac{V_{corr}}{Sl}}$$

Figure 5:
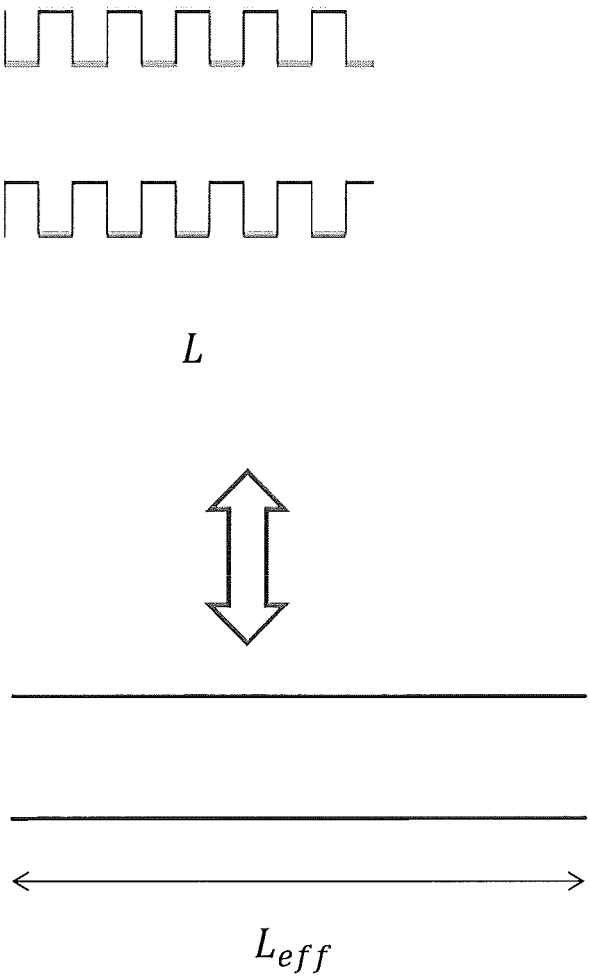
Figure 6:
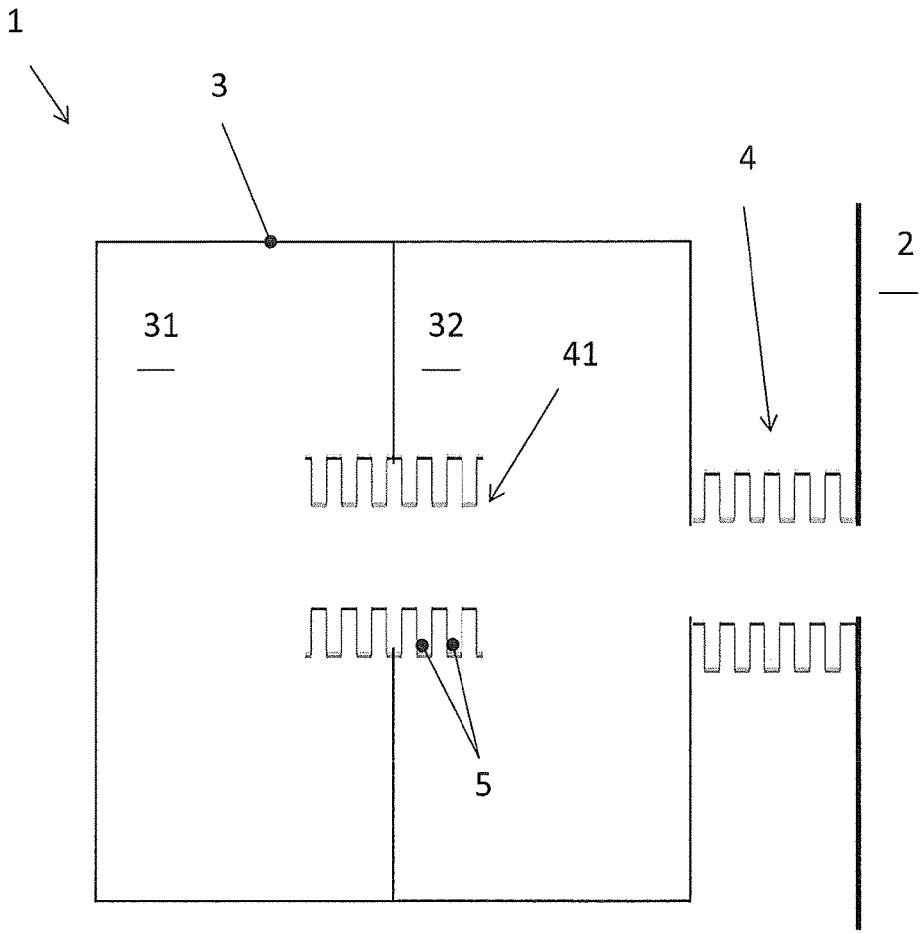
FIG. 6 schematically shows a side view of a damper according to the present invention comprising a plurality of volumes.

With reference to FIG. 5, and choosing, by way of a non-limiting example, the following geometry:

W=0.01 (corrugation width)
l=0.02 (corrugation pitch)
H=0.01 (corrugation depth)
D=0.02 (pipe diameter)

It is:

$$V_{corr} = \frac{\pi}{2} H(2H + D)W = 6.28e^{-6}$$

$$L_{eff} = L\sqrt{1 + \frac{V_{corr}}{Sl}} = 1.414L$$

Therefore, the above relation shows that the same Helmholtz damper can be realized with a neck comprising protrusions that is >40% shorter than a uniform, straight neck.

It is further to be emphasised that, advantageously, a corrugated neck presents local rigidity coupled with global flexibility. The flexibility is beneficial to allow relative movement of the resonator cavity with respect to the wall of the combustion chamber where the neck is mounted. Such arrangement allows movement of the combustion chamber due to thermal gradients acting therein without this having a negative impact of the integrity of the damper assembly.

With reference now to the last FIG. 7, it is shown another example of a damper assembly 1 according to the invention, having the corrugated neck 4 in fluid communication with the resonator cavity 3. In this exemplary embodiment, the resonator cavity 3 comprises two volumes 31 and 32 in flow communication with each other. The damper assembly 1 further comprises an intermediate neck 41, having protrusions 5, arranged to connect said two volumes (31, 32).

It will be appreciated that any kind of configuration for a damper assembly can be achieved, by means of any combination of resonator cavities, having a plurality of volumes and being interconnected through intermediate necks having protrusions according to the present invention.

Furthermore, it will be appreciated that a damper assembly according to the present invention, comprising a plurality of resonator cavities, each one comprising one or more volumes, may also comprise a combination of necks with protrusions and necks with a uniform cross-section.

Although the present invention has been fully described in connection with preferred embodiments, it is evident that modifications may be introduced within the scope thereof, not considering the application to be limited by these embodiments, but by the content of the following claims.

The invention claimed is:

1. A damper assembly for a gas turbine, the damper assembly comprising:

a resonator cavity and a neck in flow communication with said resonator cavity, said damper assembly including a plurality of protrusions located on a wall of said neck to contact a flow of a fluid from a combustion chamber to define a side wall reactance to an acoustic field to decrease an effective speed of sound in the neck as the fluid flows through the neck to the resonator cavity;

wherein the neck is mounted to a wall of the combustion chamber and is in flow communication with the combustion chamber such that the neck is between the combustion chamber and the resonator cavity so that the flow of the fluid passes from the combustion chamber and into the resonator cavity via the neck; and wherein the plurality of protrusions define a corrugated flow channel for the flow of the fluid as the flow of the fluid passes through the neck to the resonator cavity, the corrugated flow channel being configured to permit relative movement between the resonator cavity and the combustion chamber and accommodate movement of the combustion chamber due to thermal gradients acting in the combustion chamber without negatively impacting a structural integrity of the damper assembly.

2. The damper assembly according to claim 1, wherein said plurality of protrusions are annular-shaped and arranged about a circumference of said neck.

3. The damper assembly according to claim 1, wherein said plurality of protrusions are equally distanced along said neck.

4. The damper assembly according to claim 1, wherein said plurality of protrusions each have a rectangular cross-section.

5. The damper assembly according to claim 1, wherein said plurality of protrusions each have a curved cross-section.

6. The damper assembly according to claim 1, wherein said resonator cavity comprises two volumes in flow communication with each other.

7. The damper assembly according to claim 6, wherein the neck is a first neck and there is a second intermediate neck extending between the two volumes to fluidly connect the two volumes of the resonator cavity, the second intermediate neck configured to decrease an effective speed of sound in the second intermediate neck as fluid flows through the second intermediate neck.

8. The damper assembly according to claim 1, wherein said plurality of protrusions are directed outward of the neck.

9. A damper assembly in a gas turbine, the damper assembly comprising:

a first neck in flow communication with a resonator cavity, a plurality of protrusions located on an inner side wall of said first neck which contact fluid passing through the first neck as the fluid moves through the first neck toward or away from the resonator cavity to define; a side wall reactance to an acoustic field to decrease an effective speed of sound in the first neck as the fluid flows through the first neck;

wherein the first neck is mounted to a wall of a combustion chamber and is in flow communication with the combustion chamber such that the first neck is between the combustion chamber and the resonator cavity so that the fluid passes from the combustion chamber and into the resonator cavity via the first neck; and wherein the plurality of protrusions define a corrugated flow channel in the first neck through which the fluid flows as the fluid passes through the first neck to the resonator cavity, the corrugated flow channel being configured to permit relative motion between the resonator cavity and the combustion chamber and accommodate movement of the combustion chamber due to thermal gradients acting in the combustion chamber without negatively impacting a structural integrity of the damper assembly.

10. The damper assembly of claim 9, wherein the resonator cavity has a first volume and a second volume that is in fluid communication with the first volume via an intermediate second neck positioned between the first volume and the second volume, the intermediate second neck having a plurality of protrusions that define a corrugated flow path that extends between the first volume of the resonator cavity and the second volume of the resonator cavity, the corrugated flow path of the intermediate second neck being configured to decrease an effective speed of sound in the second intermediate neck as fluid flows through the second intermediate neck.

11. The damper assembly of claim 9, wherein said resonator cavity has a first volume and a second volume that is in fluid communication with the first volume via an intermediate second neck positioned between the first volume and the second volume, the intermediate second neck having a plurality of protrusions that define a corrugated flow path that extends between the first volume of the resonator cavity and the second volume of the resonator cavity, wherein fluid flows along the corrugated flow path of the intermediate second neck as the fluid passes through the second intermediate neck.

12. The damper assembly of claim 9, wherein the plurality of protrusions are annular-shaped and equally distanced along the first neck.

13. The damper assembly of claim 9, wherein the plurality of protrusions have rectangular cross-sections or curved cross-sections.

14. The damper assembly of claim 9, wherein the plurality of protrusions are equally distanced along the first neck.

15. The damper assembly according to claim 1, wherein said neck is a first neck and the resonator cavity has a first volume and a second volume that is in fluid communication with the first volume via an intermediate second neck positioned between the first volume and the second volume, the intermediate second neck having a plurality of protrusions that define a corrugated flow path that extends between the first volume of the resonator cavity and the second volume of the resonator cavity, wherein fluid flows along the corrugated flow path of the intermediate second neck as the fluid passes through the second intermediate neck.

* * * * *